US008820332B2

(12) United States Patent
Barile

(10) Patent No.: US 8,820,332 B2
(45) Date of Patent: Sep. 2, 2014

(54) COSMETIC NAIL COVERING

(76) Inventor: Maria A. Barile, Willowick, OH (US)

( * ) Notice: Subject to any disclaimer, the term of this patent is extended or adjusted under 35 U.S.C. 154(b) by 0 days.

(21) Appl. No.: 13/585,827

(22) Filed: Aug. 14, 2012

(65) Prior Publication Data

US 2012/0305019 A1 Dec. 6, 2012

Related U.S. Application Data

(62) Division of application No. 12/768,358, filed on Apr. 27, 2010, now abandoned.

(60) Provisional application No. 61/174,972, filed on May 1, 2009.

(51) Int. Cl.
*A45D 29/00* (2006.01)
*A45D 31/00* (2006.01)

(52) U.S. Cl.
CPC ..... *A45D 31/00* (2013.01); *A45D 29/004* (2013.01); *A45D 29/001* (2013.01)
USPC ..... 132/200; 132/73

(58) Field of Classification Search
USPC ..... 132/200, 73, 285, 319; 602/41–43, 54, 602/56; 206/438, 440, 441
See application file for complete search history.

(56) References Cited

U.S. PATENT DOCUMENTS

| | | | | |
|---|---|---|---|---|
| 2,979,061 | A * | 4/1961 | Greenman et al. | 132/73 |
| 3,972,325 | A * | 8/1976 | Bluestone | 128/846 |
| 5,181,914 | A * | 1/1993 | Zook | 604/307 |
| 5,464,610 | A * | 11/1995 | Hayes et al. | 424/61 |
| 5,770,583 | A * | 6/1998 | Haslwanter et al. | 514/57 |
| 6,042,679 | A * | 3/2000 | Holt et al. | 156/249 |
| 6,297,420 | B1 * | 10/2001 | Heincke | 602/41 |
| 6,416,749 | B1 * | 7/2002 | Hayes et al. | 424/61 |
| 2003/0225353 | A1 * | 12/2003 | Reider | 602/41 |
| 2004/0225248 | A1 * | 11/2004 | Klein | 602/42 |
| 2005/0010146 | A1 * | 1/2005 | Levanon et al. | 602/1 |
| 2009/0078277 | A1 * | 3/2009 | Uemura | 132/73.5 |
| 2010/0212681 | A1 * | 8/2010 | Park | 132/200 |

* cited by examiner

*Primary Examiner* — Robyn Doan
*Assistant Examiner* — Tatiana Nobrega
(74) *Attorney, Agent, or Firm* — Dwight A. Stauffer

(57) ABSTRACT

Method and apparatus for cosmetically disguising an unattractive finger or toe nail area of a negatively affected hand or foot digit by using a temporary, cosmetically appealing covering, by providing a cosmetic nail covering that will simulate the appearance of a nearby normal nail when a suitably sized and shaped cosmetic nail covering is applied to cover the nail area of the affected digit, and both the cosmetic nail covering and the nearby normal nails of the hand or foot are coated by a user with identical user-supplied nail polish. The covering is made from adhesive tape suitable for wrapping around a digit, and a pad sized and shaped to resemble a normal nail for the affected digit when the pad is adhered to the tape. The tape should enable forming a coating that is as smooth, level, and uniformly colored as natural nails when coated by conventional polish.

17 Claims, 5 Drawing Sheets

COSMETIC NAIL COVERING

CROSS-REFERENCE TO RELATED APPLICATIONS

This application is a Division of U.S. application Ser. No. 12/768,358, filed Apr. 27, 2010 now abandoned; which claims the benefit of priority from U.S. Provisional Application No. 61/174,972, filed May 1, 2009; both by Maria A. Barile.

TECHNICAL FIELD OF THE INVENTION

The present invention relates to a base for application of cosmetic composition thereupon and, more particularly to a base that is applied over finger or toe nails.

BACKGROUND OF THE INVENTION

Many people suffer from a lost or damaged, and possibly infected toe or finger nail. In addition to pain, there is the nuisance of a very unappealing appearance for a relatively long time required for re-growth of a nail. In particular, women are thus hindered from wearing sandals or open-toe shoes. An attractive cosmetic cover that does not interfere with healing of the damaged or diseased nail would be a multifold solution to this problem, that is, cosmetic and medical.

The primary medical problem is toenail fungus, which affects about 10 percent of American adults. Fungus causes the nail to become thick, yellow, and fetid. This creates an unattractive finger or toe that embarrasses the person who has the affliction, which causes the person to hide the nail, such as in a closed shoe, even in the high temperatures of summer. Another problem affects both finger and toe nails, and that is an injury to the nail portion of a digit, for example an impact severe enough to cause a blood blister under the nail. Such injuries yield unsightly discoloration at the least, and often cause loss of the nail followed by many months before a new nail grows back.

Current remedies for nail fungus are rarely successful, and treatment often involves removal of a portion of the nail. Even when an available prescription works, it takes months for a new nail to grow out and replace the diseased nail. The patient is left with a nail that is ugly, discolored, and unappealing.

In the case of a nail infection, a bandage may be required to control bleeding and to hold topical medications in place, however medical bandages are generally unattractive. Another medical issue is that untreated nail fungus can spread by shedding invisible spores when a person removes shoes and socks or goes barefoot, especially in public areas such as locker rooms. Thus, covering the diseased nail could help prevent the spread of fungal disease.

Prior art discloses multiple ways to decorate finger or toe or both nails. In general, these are placed over an existing nail primarily to provide ornamentation to the nail without attempting to disguise the nail as a normal, healthy nail, or in the case of complete nail covers such as false nails, the cover is glued—typically permanently—to the real nail underneath. This exacerbates the problem for infected nails, and is totally unsuitable for growing nails and exposed nail beds.

U.S. Pat. No. 4,567,983 (Wissman et al.: 1986) discloses a method of installing an artificial toe or finger nail at the site of a surgically removed natural nail. The disclosed invention requires preparing the exposed nail bed (12) before attaching the artificial nail by applying a separating agent and mass of plastic material. It can be seen that the Wissman et al. method is for surgically removed nails and requires medical supervision. It does not provide a simple self-applied cosmetic disguise of the affected digit to simulate a healthy nail, and it is difficult to apply and might interfere with healing if not done properly.

US Application 2005/0,010,146 (Levanon et al.: 2005) discloses a decorative bandage with an LED display, the display being for displaying a skin condition value. While hiding skin conditions, the Levanon adhesive bandage with display does not disguise a damaged or diseased or missing nail to give the appearance of a normal nail.

Prior art that hides a broken chipped nail, such as U.S. Pat. No. 2,688,331 (Bogoslowsky et al.: 1949), generally specifies adhesion directly to the existing nail. It does not provide an easily applied cosmetic covering suitable for use on infected nails or exposed nail beds.

U.S. Pat. No. 6,592,889 (Stout et al.: 2003) discloses a gel dressing that can be used in the treatment of fungus-involved or discolored toe nails. The gel dressing, while protective of the damaged toe nail, does not cosmetically disguise the affected nail, especially if the nail is misshaped in any way. Such coatings are no more effective in hiding a nail than simply applying nail polish to the nail.

Thus, there is an unmet need for a simple means of cosmetically disguising a damaged, diseased, or missing nail while also avoiding discomfort and further damage in the affected area.

BRIEF SUMMARY OF THE INVENTION

The cosmetic nail cover is a temporary covering for cosmetically hiding diseased, damaged, or missing nails on toes or fingers, especially on women. According to the invention, the nail cover is a device and method of use thereof, to create an illusion of a full, healthy nail, though not adhering directly to the damaged nail or exposed nail bed. The cover has adhesive strong enough to adhere to the skin if subjected to water or moisture. The cover is a smooth material with the capability to accept nail polish in a way that looks like the other normal nails around it. The herein disclosed method uses the cosmetic nail cover device to disguise an unappealing nail on a digit, by making it appear to be normal by covering the affected digit and enabling the application of nail polish to the covering as if it were the normal nail for the digit.

According to the invention, a strip of tape and a pad cut to size covers a diseased or damaged nail, which allows the user to apply nail polish on the strip of tape over the area where the pad is adhesively attached to the bottom of the strip of tape that is wrapped around the digit (toe or finger) to disguise the diseased or damaged nail or nail bed.

The main purpose of the current invention is to cosmetically disguise a diseased or damaged nail that provides the illusion of a healthy nail. In an embodiment according to the invention the cosmetic nail cover includes: a strip of adhesive tape, which is of suitable length to wrap around a digit, has a backing paper that protects the adhesive on the back side of the strip of tape and is removed by the user before use; and a flexible pad that the user cuts to cover the entire nail area that is diseased or damaged, and which pad the user attaches to the adhesive on the bottom of the strip of tape, after the backing paper has been removed. The user then places the pad directly over the unattractive nail and wraps the strip of tape around the skin of the digit. The user finishes the process by applying nail polish to the strip of tape over the pad that covers the diseased or damaged nail area.

According to the invention, a cosmetic nail cover is disclosed for cosmetically disguising, with a temporary covering and conventional nail polish, an unattractive nail area on a nail portion of an affected hand or foot digit; the cosmetic nail cover comprising: an elongated strip of tape that has a front side and an opposed back side; material of the tape being resistant to damage by conventional nail polish chemicals, and the front side of the tape material being suitable for application and adherence of a coating of the conventional nail polish by conventional means; an adhesive substantially coating the back side of the strip of tape, wherein the adhesive is suitable for removable adherence to skin of the hand or foot; and a flexible pad having a firm smooth top surface for adherence to the back side of the strip of tape.

Further according to the invention, the pad material is: suitable for conventionally trimming to a size and shape appropriate for the nail area of the affected digit; and has a pad thickness comparable to that of a nail for the affected digit. Preferably the tape material is substantially transparent or translucent, and the front side is non-glossy. Also preferably, the adhesive and the tape material are medically approved for application to human skin; and the pad material is medically approved for application to exposed, medicated, or healing nail beds; and has a bottom side that is sufficiently soft to avoid irritation of an exposed nail bed of the affected digit.

In an embodiment of the invention, the cosmetic nail cover is provided pre-cut and preassembled to a specific size and shape that is appropriate for cosmetically covering the nail area of a specific affected digit; such that: the pad has been trimmed to the specific size and shape appropriate for the nail area of the specific affected digit, including a curved cuticle edge of the pad spaced apart from an opposed pad outside edge by a pad length, and two opposed substantially parallel and linear lateral pad edges spaced apart by a pad width; the pad top is adhered to the adhesive coated back side of the strip of tape, with the pad length being aligned with the tape width, the pad cuticle edge being close to a cuticle edge of the strip of tape, and the pad being approximately centered in the tape length; the strip of tape has been trimmed to a tape width that aligns an outside tape edge with the outside edge of the adhered pad, and a tape length sufficient to wrap approximately once around the nail portion of the specific affected digit; and a strip of backing paper is releasably adhered to substantially all exposed portions of the adhesive coating, and also covers the pad bottom.

In an embodiment of the invention, the strip of tape is provided in a plurality of tape widths and the pad is separately provided in one or more pre-cut shapes and sizes.

In an embodiment of the invention, the tape material with adhesive coating, and the pad material, are supplied separately in a kit with instructions for trimming and assembling a cosmetic nail cover that has a size and shape appropriate for covering the nail area of an affected digit.

According to the invention, a method is disclosed for cosmetically hiding an unattractive finger or toe nail area of an affected digit with a temporary, cosmetically appealing covering, the method comprising the steps of: providing tape material that has a back side substantially coated with an adhesive suitable for releasably adhering to human skin, and that has an opposed front side that is suitable for coating with nail polish; trimming the tape material to form a strip of tape having a tape length sufficient to wrap approximately once around the nail portion of the affected digit; providing pad material that is semi-rigid and which presents a smooth firm surface on a top side; trimming the pad material to form a pad having a pad length, a pad width, and a cuticle edge curved shape appropriate for a desired shape of nail for the nail area of the affected digit; removing backing paper, if present, from the adhesive on the back side of the strip of tape; positioning the pad on the adhesive coated side of the strip of tape such that the pad length is aligned with the tape width, the pad cuticle edge is close to a cuticle edge of the strip of tape, and the pad is approximately centered in the tape length; pressing to adhere the pad top surface to the strip of tape; positioning the pad over the nail area of the affected digit with the adhesive coating facing the digit; wrapping the strip of tape around the affected digit; trimming a pad outside edge and a corresponding outside tape edge as needed to form a desired shape and dimensions for the outside edges of the nail covering; and applying nail polish on the tape front side above the pad as cosmetic decoration to match that of other nails, thereby presenting the appearance of one nail-polished natural nail among others on the same hand or foot.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
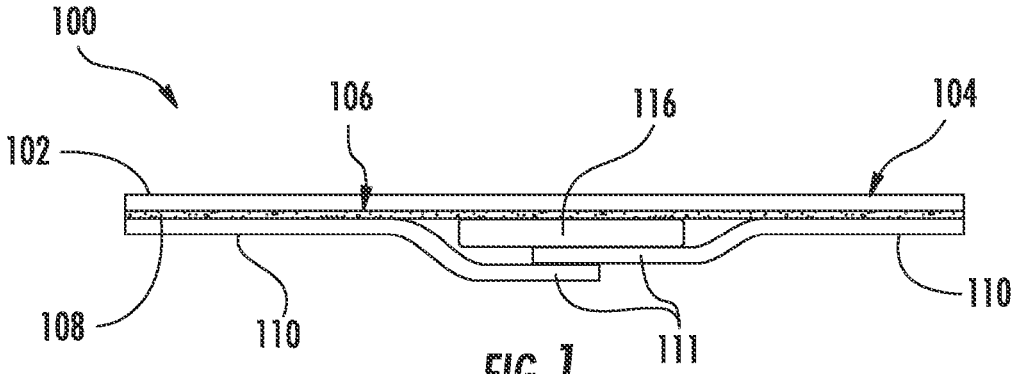

The structure, operation, and advantages of the present preferred embodiment of the invention will become further apparent upon consideration of the following description taken in conjunction with the accompanying drawings, wherein:

FIG. 1 is a side view of a pre-assembled embodiment of a cosmetic nail cover, according to the present invention.

Figure 2:
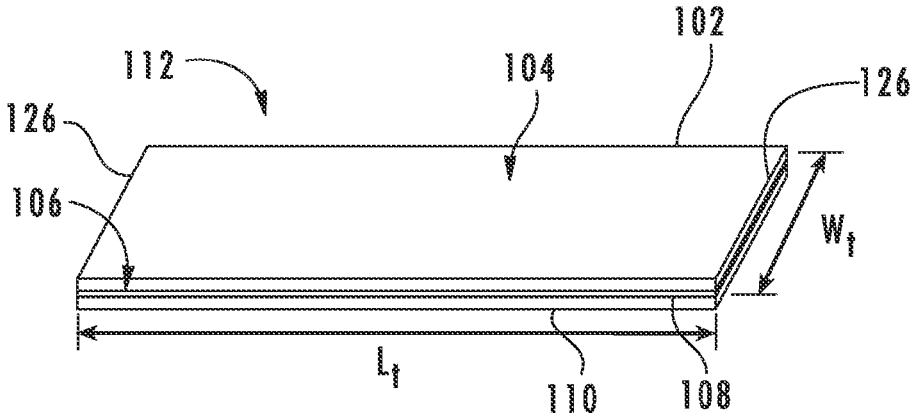

FIG. 2 is a perspective view of a strip of tape with adhesive and backing paper, according to the present invention.

Figure 3A:
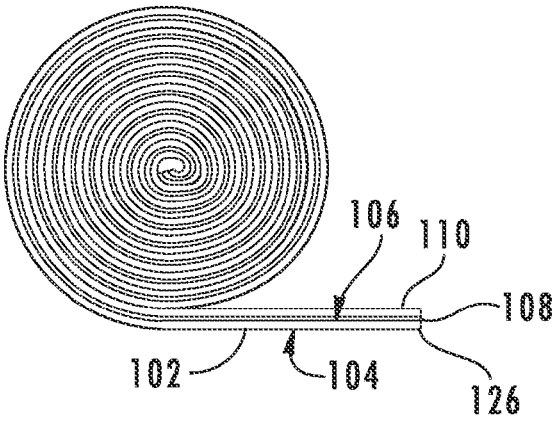
Figure 3B:
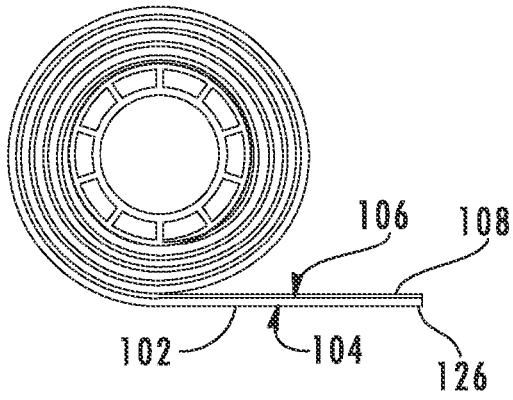

FIGS. 3A and 3B are side views of two examples of tape material provided in a roll format; as a coil with backing paper, and on a spool, respectively, according to the present invention.

Figure 4:
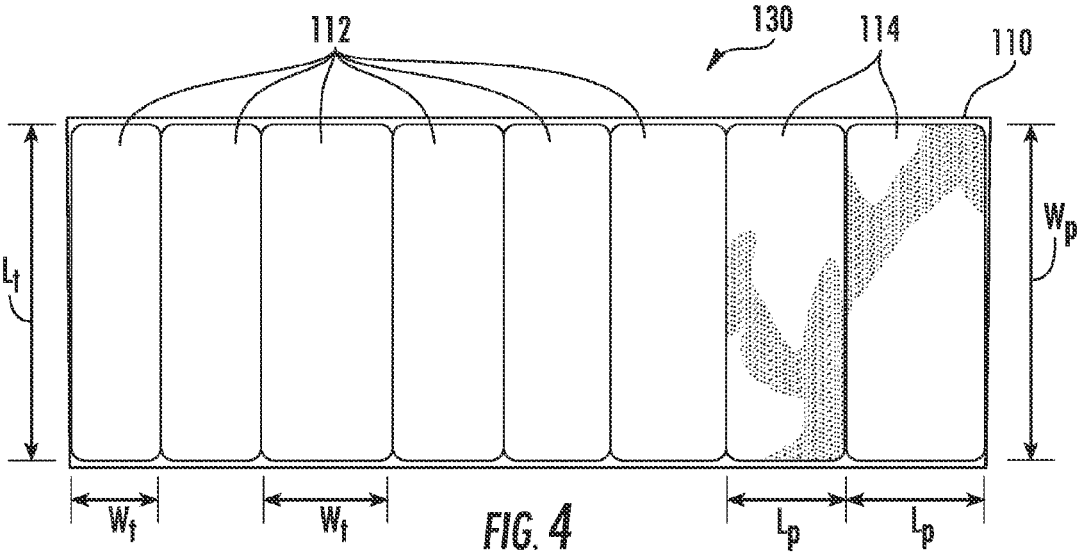

FIG. 4 is a top view of an assortment of strips of tape of different widths, and two pieces of pad material, all provided on a card of release paper, according to the present invention.

Figure 5:
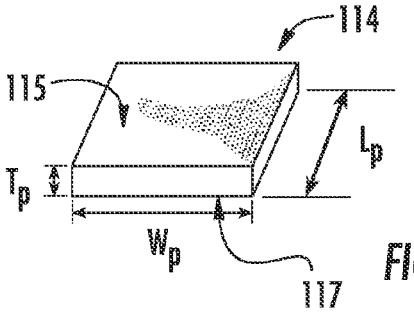

FIG. 5 is a perspective view of pad material, according to the present invention.

Figure 6:
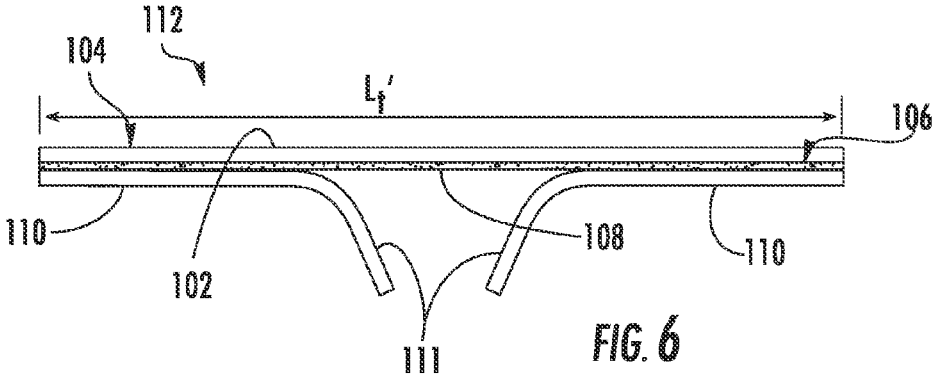

FIG. 6 is a side view of a strip of tape with inside ends of the backing paper partly peeled away from the adhesive on the back side of the tape material, according to the present invention.

Figure 7:
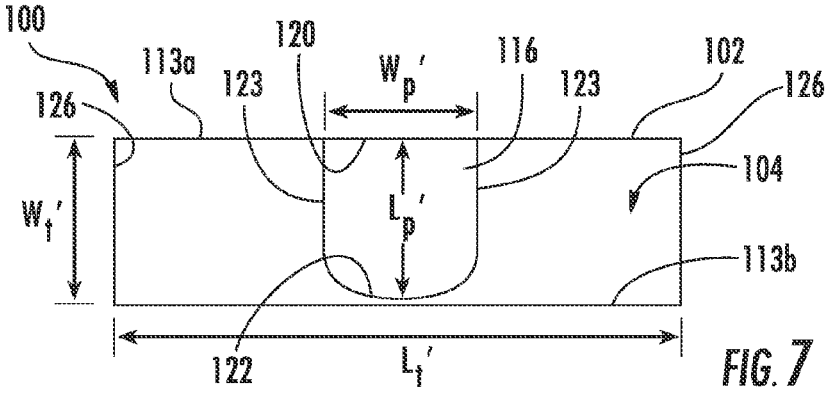

FIG. 7 is a top view of an assembled cosmetic nail cover, according to the present invention.

Figure 8:
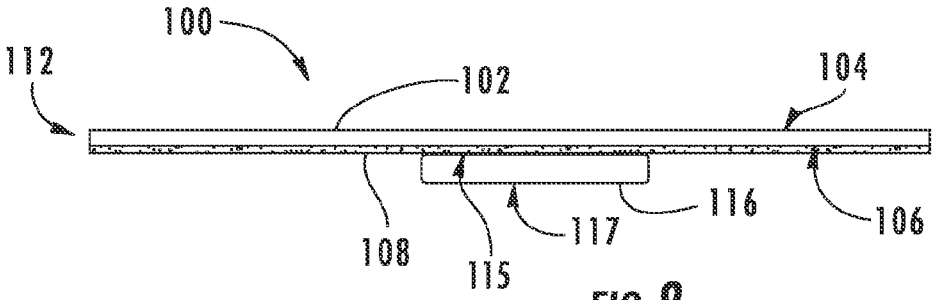

FIG. 8 is a side view of the assembled cosmetic nail cover of FIG. 7, according to the present invention.

Figure 9:
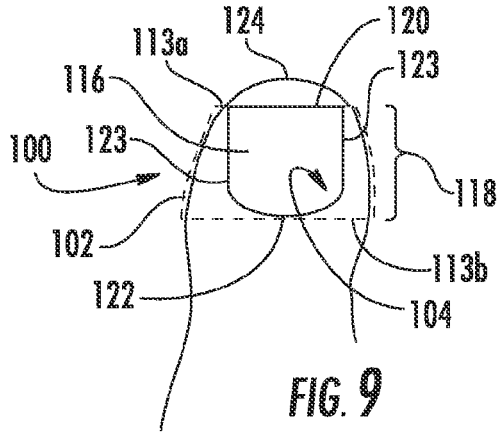

FIG. 9 is a top view of the cosmetic nail cover after it has been applied to a nail portion of a digit according to the present invention.

FIGS. 10-17 illustrate the process of assembling the cosmetic nail cover, applying it to a digit, and applying cosmetic decoration, according to the present invention.

Figure 10:
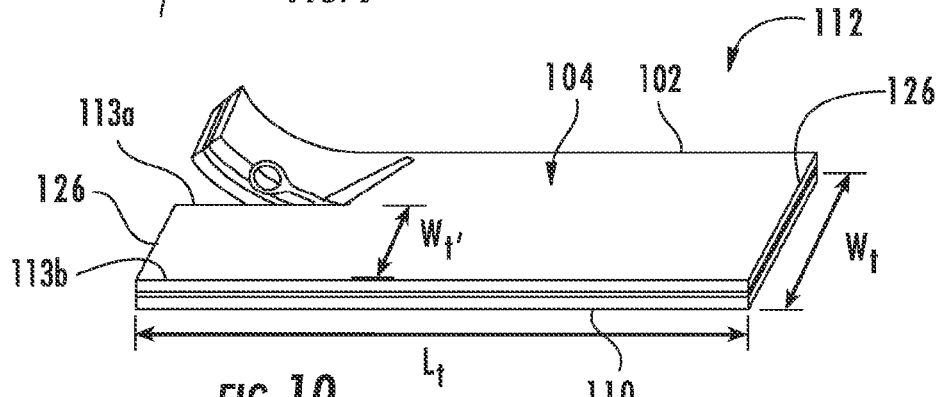

FIG. 10 is a perspective view of the step of trimming a strip of tape to a desired cut width, according to the present invention.

Figure 11:
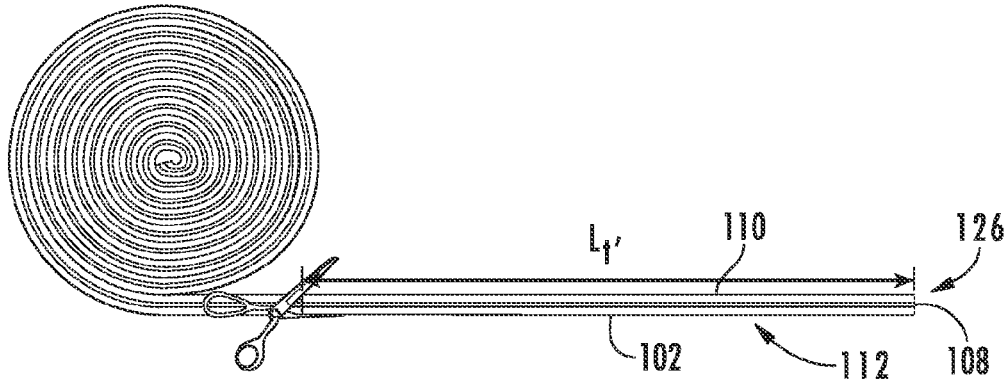

FIG. 11 is a side view of the step of cutting a strip of tape with a desired cut length Lt' from tape material in the coil of tape of FIG. 3A, according to the present invention.

Figure 12:
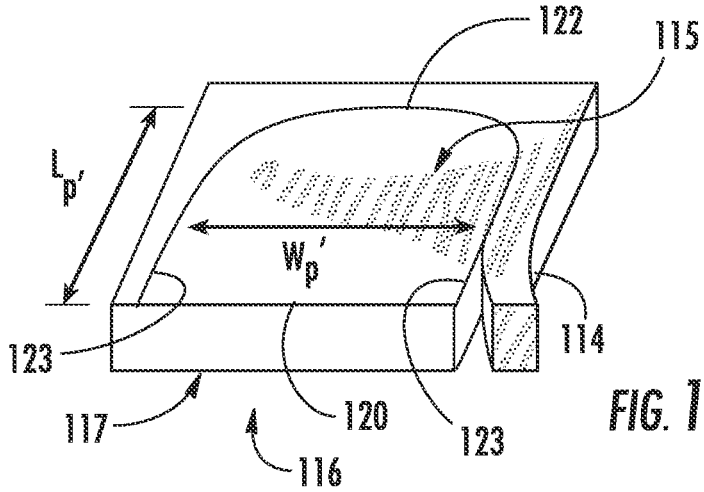

FIG. 12 is a perspective view of the step of cutting a pad with a desired size and shape from pad material, according to the present invention.

Figure 13:
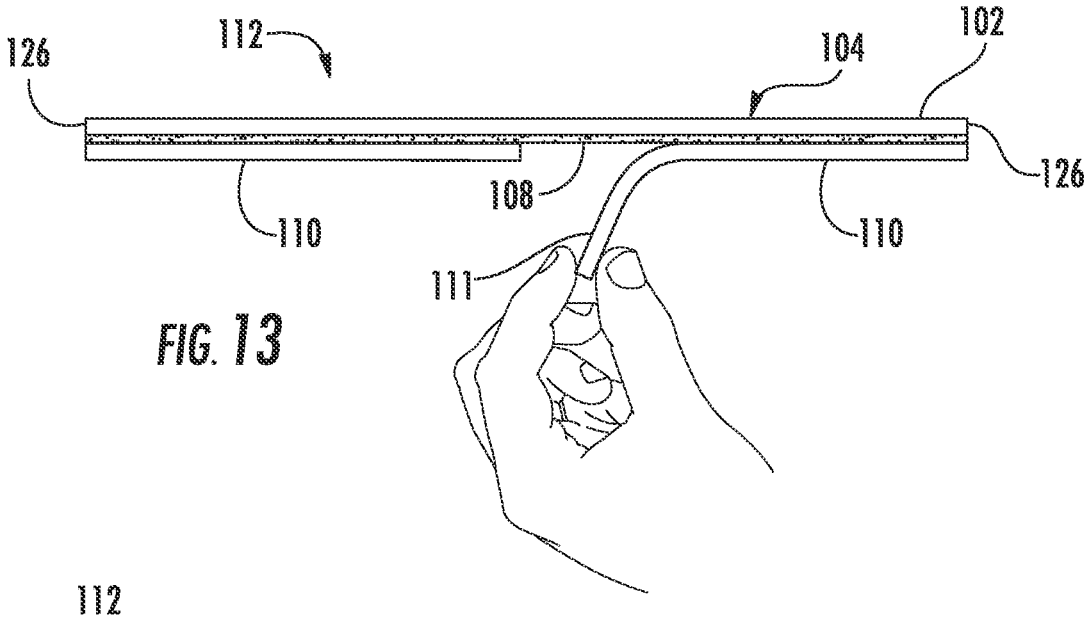

FIG. 13 is a side view of the step of peeling the backing paper away from a strip of tape, according to the present invention.

Figure 14:
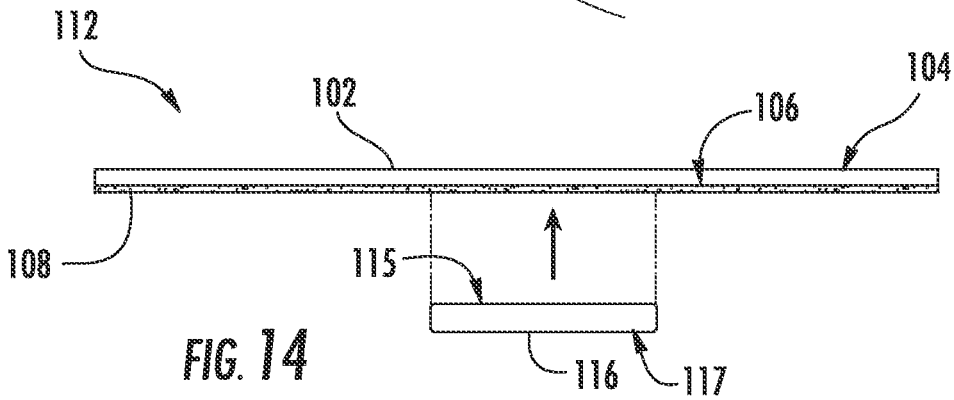

FIG. 14 is a side view of the step of adhering the pad to the strip of tape, according to the present invention.

Figure 15:
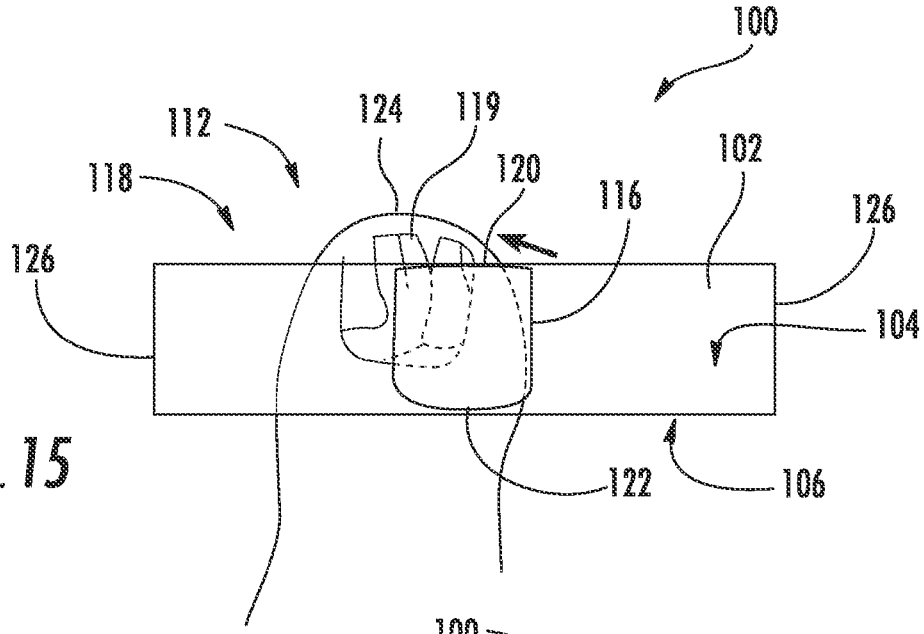

FIG. 15 is a top view of the step of aligning the cosmetic nail cover with a nail area of the digit, according to the present invention.

Figure 16:
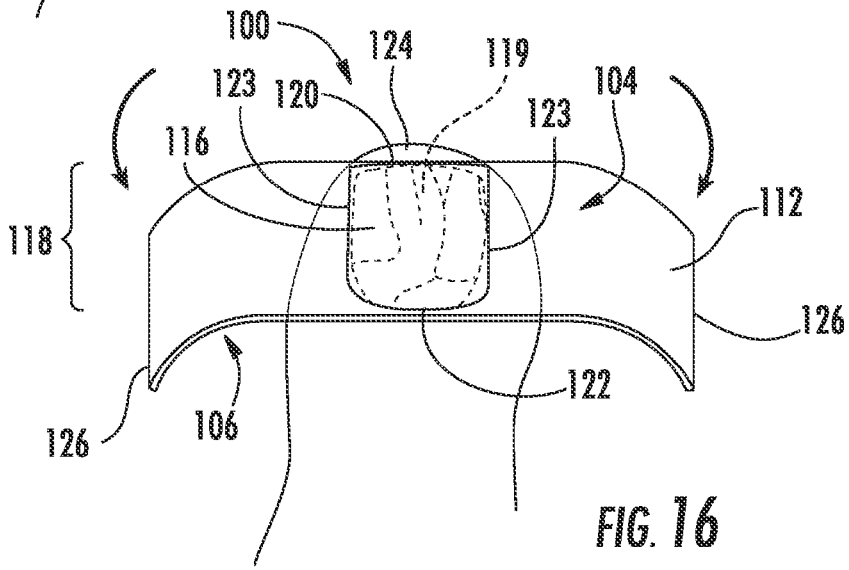

FIG. 16 is a top view of the step of wrapping the cosmetic nail cover's strip of tape around the nail portion of the digit, according to the present invention.

Figure 17:
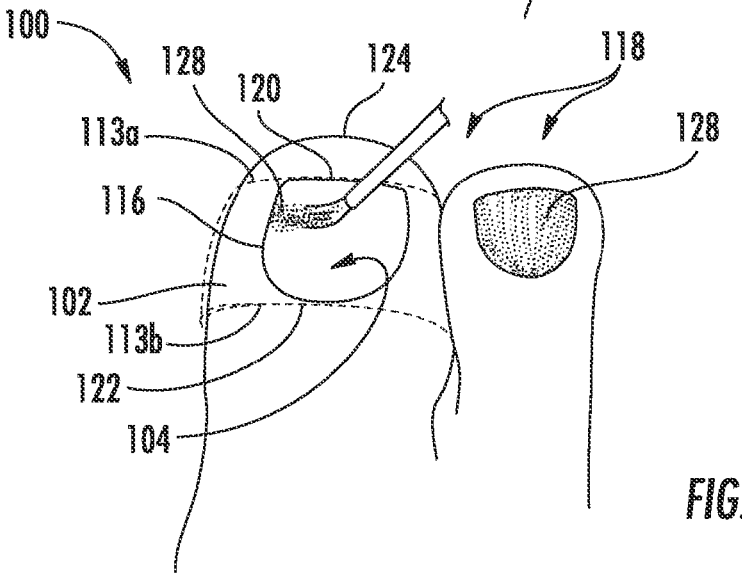

FIG. 17 is a top view of the step of applying nail polish to the applied cosmetic nail cover, according to the present invention

DETAILED DESCRIPTION OF THE INVENTION

For the sake of clear and focused description, the present disclosure is primarily discussed and illustrated with reference to exemplary embodiments of a "cosmetic nail cover," however, it should be understood that the invention is not limited to the details of structure and the arrangement of the components set forth in the disclosed embodiments. Rather, these embodiments are merely suggestive of many modes of implementation of the inventive concept(s).

As shown in FIGS. 9 and 17, the present invention cosmetically disguises an unattractive nail area 119 of an affected digit 124 having a diseased or damaged nail 119 or exposed nail bed 119 caused, for example, by physical trauma or, for example, by a medical problem such as nail fungus. The inventive cosmetic nail cover 100 hides an unsavory nail area 119 beneath a pad 116 that is held in place on the affected digit 124 by a strip of tape 112 with adhesive 108 (see FIG. 13). The cosmetic nail cover 100 provides a firm, smooth, nail-shaped tape top surface 104 that is receptive to an application of nail polish 128 (provided by the user) as desired by the user to provide a temporary cosmetic affect that appears to be a normal nail decorated with nail polish 128 like the surrounding nails. The terms nail portion 118 of an affected digit 124 will be used herein to refer to the part of a digit that underlies the nail area 119, wherein the nail area 119 references the area normally covered by a natural nail including any portions of nail or nail bed that lie within the nail area 119. An "affected digit" 124 is a specific one of the fingers or toes that has a nail area 119 that the user desires to cosmetically hide with the cosmetic nail cover 100.

FIG. 1 shows an assembled embodiment of the cosmetic nail cover 100 as it can be supplied to a user (e.g., by retail sale, in appropriate packaging, not shown). Referring also to FIG. 8, the cosmetic nail cover 100 comprises an elongated strip of tape 112 made of a tape material 102 that has a front side 104 (or top side as shown) and an opposed back (or bottom) side 106 that is substantially coated with an adhesive 108 suitable for removably adhering to human skin of the hand or foot, and is preferably water resistant. Adhered by the adhesive 108, approximately centered on the strip of tape 112, is a flexible pad 116 having a pad thickness Tp (shown in FIG. 5) comparable to that of a finger or toe nail 119. The pad 116 has a firm smooth top surface 115, which is the side of the pad 116 that is adhered to the back side 106 of the strip of tape 112; and an opposed bottom side 117 that is preferably sufficiently soft to avoid irritation of an exposed nail bed 119 of the affected digit 124. Where the tape material 102 is adhered to the firm smooth top surface 115 of the pad 116, it conforms such that the front (top) side 104 of the tape material 102 also becomes firm and smooth like a natural finger or toe nail. For further enabling cosmetic application of nail polish 128, the tape material 102 is resistant to damage by conventional nail polish 128 chemicals, and the front side 104 of the tape material is suitable for application and adherence of a coating of the conventional nail polish 128 by conventional means (e.g., by brush). A non-glossy front surface 104 is preferred for suitably aiding uniform adherence of the nail polish 128. It is also preferred, along with transparency or translucence for visually "hiding" the strip of tape 112 on the skin of the digit 124, given that these characteristics avoid unnatural light reflection and allow the normal skin color to show through.

FIG. 1 further shows an embodiment of a retail version of a preassembled cosmetic nail cover 100 wherein releasable backing paper 110 protects both the adhesive layer 108 and the pad 116 until use, preferably with overlapping ends 111 to make removal easier. Although this pre-assembled embodiment of the cosmetic nail cover 100 is also pre-cut to specific strip of tape 112 and pad 116 size and dimensions, the user can be instructed to trim the tape length Lt and the tape width Wt (and pad length Lp along with it) as needed to accommodate a smaller circumference nail portion 118 or a shorter length nail area 119 of the affected digit 124. The pad width Wp is essentially fixed since it is difficult to trim once the pad 116 is adhered to the strip of tape 112 during preassembly. Such preassembled and pre-cut cosmetic nail covers 100 may be packaged as one size or an assortment of sizes in various tape/pad lengths and widths suitable for covering different sized/shaped nail portions 118 of digits 124.

Referring now to FIGS. 1, 15, 16, and 17, a preassembled and precut embodiment of the cosmetic nail cover 100 may be provided with instructions for its application and finishing, such as the following:

- remove the backing paper 110 from the cosmetic nail cover 100;
- position the pad 116 over the nail area 119 of the affected digit 124 with the adhesive coating 108 facing the digit 124;
- wrap the strip of tape 112 around the affected digit 124;
- trim a pad outside edge 120 and a corresponding outside tape edge 113*a* as needed to form a desired shape and dimensions for the outside edges 113*a*, 120 of the nail covering 100; and
- apply nail polish 128 on the tape front side 104 above the pad 116 as cosmetic decoration to match that of other nails, thereby presenting the appearance of one nail-polished natural nail among others on the same hand or foot.

Referring to FIGS. 2, 3A, 3B, 4 and 5, the inventive product may be sold as a kit 130 that includes a supply of tape material 102 with adhesive coating 108, and pad material 114. Preferably instructions are also provided that describe trimming the supplied materials 102, 114 to a desired shape and size, assembling a cosmetic nail cover 100, applying it to an affected digit 124, and cosmetically decorating it (e.g., with nail polish 128).

FIGS. 3A-3B show two embodiments of the adhesive 108 coated tape material 102 being provided in a roll form. FIG. 3A illustrates a loose coil of the tape material 102 with backing paper 110 releasably adhered to it by the adhesive coating 108. FIG. 3B illustrates the tape material 102 with adhesive coating 108 but without backing paper 110, all rolled on a spool like a roll of one-sided adhesive tape.

FIG. 2 shows one of several individual strips of tape 112 that are pre-cut to a tape length Lt between tape ends 126 and to a tape width Wt. The strip of tape 112 is made of the tape material 102 with a front side 104 and an opposed back side 106 that is substantially coated with an adhesive 108, which in turn is covered by a layer of backing paper 110 that is releasably adhered to the adhesive coating 108 for the purpose of preventing unwanted sticking of the adhesive 108 to other surfaces such as, for example, a retail package (not shown) that holds several of the strips of tape 112.

FIG. 5 shows one of several individual pieces of pad material 114 that are pre-cut to a pad length Lp and to a pad width Wp. The pad material 114 has a pad top 115 and an opposed pad bottom 117.

The individual strips of tape 112 and the individual pieces of pad material 114 can be provided in a plurality of sizes (width and length dimensions) suitable for trimming as needed to form a pad 116 and strip of tape 112 having specific sizes and shapes appropriate for covering a specific affected nail area 119.

FIG. 4 illustrates another embodiment of bulk material provisioning, wherein an assortment of pre-cut strips of tape 112 with adhesive 108, and pad material 114 are releasably adhered on a sheet (or "card") of backing paper 110, thereby making an example embodiment of a kit 130. The tape length Lt and tape width Wt (varied among the strips); and the pad width Wp and pad length Lp (varied among the pieces) are labeled assuming that pads 116 would be made using rectangles of pad material 114 cut across (horizontal as illustrated) the vertical strips of pad material 114 on the card 110.

To assemble a cosmetic nail cover having a shape and size appropriate for the nail portion 118 of the affected digit 124 (e.g., as in FIG. 9), the user cuts the supplied tape material 102 (e.g., as in FIG. 11) to form a strip of tape 112 with a trimmed tape length Lt' sufficient for wrapping substantially around the nail portion 118 of the affected digit 124. The user also cuts the strip of tape 112 (e.g., as in FIG. 10) to a trimmed tape width Wt' sufficient to cover the nail area 119 without extending beyond the end of the affected digit 124 (see FIG. 16).

Referring to FIG. 12, the user also cuts the pad material 114 to a trimmed pad width Wp' and trimmed pad length Lp' that correspond to a desired shape and size that at least covers the nail area 119 by the opaque pad 116 of the cosmetic nail cover 100, thereby making the pad 116 look like a normal nail for the affected nail area 119. To look like a typical normal nail (and nail area 119), a pad 116 is typically trimmed to have the trimmed pad width Wp' between two substantially parallel and linear opposed lateral side edges 123; and to have the trimmed pad length Lp' between a pad outside edge 120 (shown straight across as for a "square-cut" toenail) and a pad cuticle edge 122 that is roughly U-shaped to follow the curve of a cuticle.

In the best mode, the tape material 102 is resistant to damage by chemicals in commonly used (conventional) nail polish, and the strip of tape 112 has an adhesive 108 on its back side 106 that is approved for medical use such as for over-the-counter bandage tape and is resistant to moisture. The tape material 102 is preferably translucent or transparent and has a non-glossy front surface 104 so that, once applied to the skin, the tape material 102 is unseen and the skin shows through. Furthermore, a non-glossy (matt) surface is more likely to be suitable for application and adherence of a layer of nail polish, e.g. brushing on without beading up. An example of a commercially available product meeting these criteria is product #9865A by 3M (St. Paul, Minn.), which is a polyethylene film (tape) supplied with adhesive on one side. Polyethylene film is known to have good resistance to chemicals such as inks, coloring, carrier fluids, and the like that are typically used in conventional "nail polish". Listed material properties that make the #9865A product (film with adhesive) particularly suitable are: hypoallergenic, suitable for repeat/chronic skin contact, "medium" conformability, fluid resistant, "printable", and transparent (preferred, but is also available in "tan" and "blush tan" colors). The printable characteristic means that paint or ink, and therefor likely nail polish (enamel lacquer) will adhere when applied by conventional means. Additional properties that are advantageous include: average adhesion, sterilizable, 3.0 mil (0.003") thick film with good tensile strength and moderately low elongation, and supplied on a roll with a liner (release paper) protecting the adhesive.

Embodiments of the tape material 102 as it may be supplied include, for example, a preassembled cosmetic nail cover 100 (FIG. 1), or for example, pre-cut strips of tape 112 (FIGS. 2, 4), or for example a roll of tape material 102 (FIGS. 3A, 3B). In a less-preferred embodiment, the tape material 102 may be perforated for ventilation, but perforations are not suitable for the tape material 102 that is on top of the adhered pad 116 due to a resultant uneven front surface 104 for painting with nail polish 128. A way to provide ventilation may be to perforate the assembled nail cover 100 only where the tape material 102 doesn't sit on top of the adhered pad 116, where it is to be painted.

As shown in FIG. 12, kit instructions could, for example, suggest that the user "trace around" the nail portion 118 on paper to create a template which is then transferred to the pad material 114, or to simply trace a line directly on the pad material 114, for cutting the pad material 114 to the appropriate shape and size to create the pad 116 with a trimmed pad length Lp' and trimmed pad width Wp'. A uniform curvature for the pad cuticle edge 122 can generally be approximated by eye.

The inventor's measurements, and/or a survey of "false nail" dimensions in the market, indicate what may be a best mode set of strip of tape 112 and pad 116 dimensions for nail beds 119 of an average set of finger or toe digits 124. The following listing of dimensions is a preferred but non-limiting example of a set of tape widths Wt and tape lengths Lt plus corresponding pad widths Wp and pad lengths Lp for an "average" set of toe nails (i.e. toe nail beds) 119. A pad cuticle edge 122 radius of curvature is also listed. The pad lengths are not listed because they are assumed to be approximately equal to their corresponding tape widths Wt. The largest dimensions are for the "big toe" digit 124, and are a tape width Wt of ¾ inch and a tape length Lt of 3½ inches, with a corresponding pad width Wp of 11/16 inch (and pad length Lp of ¾ inch). Radius of curvature is 11/64 inch. Dimensions for the other toe digits 124 are a tape width Wt of ⅜ inch and tape length Lt of 2⅜ inch, with a pad width Wp of ⅜ inch and a radius of curvature of 9/64 inch; tape width Wt of 5/16 inch and tape length Lt of 2 3/8 inches, with a pad width Wp of 5/16 inch and a radius of curvature of 9/64 inch; tape width Wt of 1/4 inch and tape length Lt of 2 1/4 inches, with a pad width Wp of 5/16 inch and a radius of curvature of 9/64 inch; and tape width Wt of 3/16 inch and tape length Lt of 2 1/4 inches, with a pad width Wp of 1/4 inch and a radius of curvature of 5/64 inch. A similar set of dimensions appropriate for covering an average set of finger nail beds 119 is easily determined by making measurements on a number of people. Although such an "average" set of cosmetic nail covers 100 can be supplied in a package, it is advantageous to make them from tape material 102 and pad material 114 that is suitable for conventionally trimming (e.g., by common paper scissors) to adjust for individual variations from the average. In another advantageous embodiment, pre-assembled (and pre-cut) cosmetic nail covers 100 are packaged as several tape strips 112 of a standard tape length Lt and just a few tape widths Wt, and a suitable range of pad widths Wp for each corresponding pad length Lp (equaling the tape width Wt). The user selects an appropriate pad width Wp for the affected nail area 119, then trims the tape length Lt, tape width Wt, and pad length Lp as needed to fit the affected nail portion 118 and nail area 119 of the affected digit 124.

Referring to FIGS. 5 and 7, the pad material 114 has a pad top surface 115 that is firm and smooth to form a good surface for applying nail polish 128 on the front surface 104 of the tape material 102 where it is adhered to the top surface 115 of a pad 116 made from the pad material 114. The pad material 114 is preferably flexible for conforming to contours of the nail portion 118 of the affected digit 124 (e.g., cylindrically convex), and is preferably semi-rigid to hold its shape under the strip of tape 112. It preferably has a closed cell structure (without porosity), is fluid resistant and is approved for medical use. The pad thickness Tp is preferably comparable to that of a nail for the affected digit 124, for example approximately 10 mils (0.010 inch) thick. An example of commercially available product meeting these criteria is product #9776 by 3M (St. Paul, Minn.), which is a 10 mil, closed cell polyethylene "medical foam" with "medium" conformability, supplied in a "tan" color (preferred so that the outside edge 120 will not stand out as an unnatural pure white color). It is non-porous, fluid resistant, sterilizable, hypoallergenic, and approved for repeat skin contact.

FIG. 6 shows a side view of the strip of tape 112 wherein tape material 102 is cut to a trimmed tape length Lt'. The backing paper 110 has ends 111 partly peeled away to expose the adhesive coating 108 that is on the tape back 106. Once the backing paper 110 is removed and the pad 116 is adhered to the strip of tape 112, the user can apply the now-assembled cosmetic nail cover 100 to the affected digit 124.

FIG. 7 shows a top view of the assembled cosmetic nail cover 100. The pad 116 is approximately centered relative to the trimmed length Lt' and the trimmed width Wt' of the strip of tape 112, and is adhered to the back side 106 of the tape material 102 by the adhesive 108. The pad 116 has been trimmed to the specific size and shape appropriate for the nail area 119 of the specific affected digit 124, including a curved cuticle edge 122 spaced apart from an opposed pad outside edge 120 by a trimmed pad length Lp', and two opposed, substantially parallel and linear, lateral pad edges 123 are spaced apart by a trimmed pad width Wp'. The outside pad edge 120 is preferably flush with the outside tape edge 113*a*, and the cuticle pad edge 122 is preferably flush with the cuticle tape edge 113*b*.

FIG. 8 shows a side view of the assembled cosmetic nail cover 100. The top surface 115 of the pad 116 is adhered to the back side 106 of the strip of tape 112 by the adhesive coating 108 on the tape material 102 (and also on the pad 116 if it comes with its own adhesive 108).

FIG. 9 illustrates the cosmetic nail cover 100 applied to the nail portion 118 of the affected digit 124. The pad 116 is trimmed such that the lateral edges 123 and the curved cuticle edge 122 substantially align with corresponding edges of the nail area 119 of the affected digit 124, thereby substantially covering the nail area 119. The strip of tape material 102 is wrapped around the nail portion 118 of the digit 124. Because it is clear and non-glossy the tape material 102 essentially disappears, as indicated by a ghosted outline.

FIGS. 10-17 illustrate a process (method) for cutting, assembling, applying and finishing a cosmetic nail cover 100 using supplies provided in a kit 130.

As shown in FIG. 10, a user cuts a length Lt from, for example, a roll of tape material 102. The instructions could tell the user to cut a strip of tape 112 to sufficiently wrap around an affected digit 124 approximately one time. The user can, but only if necessary, cut the strip of tape 112 lengthwise, as illustrated in FIG. 11, to reduce the tape width Wt to sufficiently cover the affected nail bed 119 without protruding over the outside end of the digit 124. The user then cuts the pad material 114 to create the pad 116 (see FIG. 12). To determine the desired shape and size of the pad 116, a user may trace around the nail area 119 on a piece of paper to form a template for trimming the pad material 114 to a trimmed pad width Wp' and trimmed pad length Lp' having a matching cuticle edge 122 shape, that are appropriate for covering the nail area 119 of the affected digit 124 with the pad 116. Next, the user peels off the backing paper 110 from the strip of tape 112 as shown in FIG. 13, and applies the pad 116 approximately centered on the adhesive 108 of the tape back 106 on the strip of tape 112, which FIG. 14 illustrates. To apply the assembled cosmetic nail cover 100 to the affected digit 124, the user aligns the pad 116 over the nail portion 118 of the affected digit 124 (shown in FIG. 15 being moved down into position), and wraps the strip of tape 112 around the digit 124 approximately one time, as shown in FIG. 16, preferably overlapping the tape ends 126 for a strong hold. FIG. 17 illustrates the last step in the process of cosmetically disguising an unattractive nail 119 by applying conventional nail polish 128 on the portion of the tape material 102 that is over the pad 116. The dotted lines on the drawing, indicating edges of the tape material 102 (e.g., outside edge 113*a* and cuticle edge 113*b*), show how the tape material 102 becomes practically invisible due to its preferred properties of being translucent or transparent and non-glossy, such that skin color shows through in a natural way. The illustration in FIG. 17 includes an adjacent toe to show how the covered nail portion 118 of the affected digit 124 looks just like the adjacent natural nail when both are painted with nail polish 128.

Although the invention has been illustrated and described in detail in the drawings and foregoing description, the same is to be considered as illustrative and not restrictive in character—it being understood that only preferred embodiments have been shown and described, and that all changes and modifications that come within the scope of the invention as claimed are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A method for cosmetically disguising an unattractive finger or toe nail area of a negatively affected hand or foot digit by using a temporary, cosmetically appealing covering, the method comprising the steps of:

providing a cosmetic nail covering that will simulate the appearance of a nearby normal nail when a suitably sized and shaped cosmetic nail covering is applied to cover the nail area of the affected digit, and both the cosmetic nail covering and the nearby normal nails of the hand or foot are coated by a user with identical user-supplied nail polish; where the cosmetic nail covering is constructed from a strip of adhesive tape material suitable for wrapping around a digit and a pad of material that is sized and shaped to resemble a normal nail for the affected digit; the pad having a pad length, a pad width, and a cuticle edge curved shape that are appropriate for a nail on the nail area of the affected digit; where the pad is adhered to the strip of adhesive tape material such that the pad length is aligned with the tape width, and the tape width is equal to or greater than the pad length;

positioning the pad over the nail area of the affected digit;

wrapping and adhering the strip of adhesive tape around the affected digit; thereby holding the pad in position, including pulling it into a cylindrically curved shape similar to that of a normal nail on the affected digit; and applying nail polish on the tape above the pad as cosmetic decoration to match that of similarly coated nearby nails, thereby presenting the appearance of one nail-polished natural nail among others on the same hand or foot.

2. The method of claim 1, further comprising the steps of:

providing tape material that has a back side substantially coated with an adhesive suitable for releasably adhering to human skin, and that has an opposed front side that is suitable for coating with conventional nail polish to produce a cosmetic appearance substantially the same as that of natural nails so coated;

wherein suitability for coating is defined to mean having surface characteristics that enable forming a coating that is as smooth, level, and uniformly colored as natural nails when coated by conventional means and method; and providing pad material that is semi-rigid and which presents a smooth firm surface on a top side, even when bent into a cylindrically curved shape.

3. The method of claim 1, wherein:

the adhesive tape material is medically approved for non-irritating use on human skin; and the pad material is medically approved for non-irritating application on exposed, medicated, or healing nail beds; thereby avoiding irritation of the nail area of the affected digit.

4. The method of claim 1, further comprising the step of:

simulating the appearance of a nearby normal nail by providing the pad material with a thickness predetermined to be comparable to that of a typical nail for users in a target market.

5. The method of claim 1, further comprising the step of:

simulating the appearance of a nearby normal nail by providing tape material that is transparent or translucent, and is non-glossy.

6. The method of claim 1, further comprising the steps of:

providing the strip of adhesive tape in one or more tape widths; and providing the pad separately from the strip of adhesive tape, in one or more pre-cut shapes and sizes.

7. The method of claim 1, further comprising the steps of:

providing the cosmetic nail covering in a kit comprising separate components of:

the adhesive tape with adhesive coating on one side;

the pad material; and user instructions for constructing and applying a cosmetic nail covering that has a size and shape that the user determines to be appropriate for cosmetically covering the nail area of an affected digit.

8. The method of claim 1, further comprising the step of:

providing the cosmetic nail covering in a preselected plurality of sizes and shapes that are pre-cut and preassembled for cosmetically covering the nail area of a range of users' digit sizes predetermined to be comparable to those of typical users in a target market.

9. The method of claim 1, further comprising the step of:

trimming an outside pad edge and a corresponding outside tape edge to form a desired shape and dimensions for the outside edge of the nail covering.

10. A method for cosmetically disguising an unattractive finger or toe nail area of a negatively affected hand or foot digit by using a temporary, cosmetically appealing covering, the method comprising the steps of:

providing a cosmetic nail covering that will simulate the appearance of a nearby normal nail when a suitably sized and shaped cosmetic nail covering is applied to cover the nail area of the affected digit, and both the cosmetic nail covering and the nearby normal nails of the hand or foot are coated by a user with identical user-supplied nail polish; where the cosmetic nail covering is constructed from a strip of adhesive tape material suitable for wrapping around a digit and a pad of material that is sized and shaped to resemble a normal nail for the affected digit; and where the cosmetic nail covering is constructed by the steps of:

trimming the pad to form the pad to have a pad length, a pad width, and a cuticle edge curved shape that are appropriate for a nail on the nail area of the affected digit; and adhering the pad material to the strip of adhesive tape such that the pad length is aligned with the tape width, and the tape width is equal to or greater than the pad length;

and applying the cosmetic nail covering by the steps of:

positioning the pad over the nail area of the affected digit;

wrapping and adhering the strip of adhesive tape around the affected digit; thereby holding the pad in position, including pulling it into a cylindrically curved shape similar to that of a normal nail on the affected digit; and applying nail polish on the tape above the pad as cosmetic decoration to match that of similarly coated nearby nails, thereby presenting the appearance of one nail-polished natural nail among others on the same hand or foot.

11. The method of claim 10, further comprising the steps of:

selecting tape material that has a back side substantially coated with an adhesive suitable for releasably adhering to human skin, and that has an opposed front side that is suitable for coating with conventional nail polish to produce a cosmetic appearance substantially the same as that of natural nails so coated;

wherein suitability for coating is defined to mean having surface characteristics that enable forming a coating that is as smooth, level, and uniformly colored as natural nails when coated by conventional means and method; and selecting pad material that is semi-rigid and which presents a smooth firm surface on a top side, even when bent into a cylindrically curved shape.

12. The method of claim 10, further comprising the steps of:

selecting adhesive tape material that is medically approved for non-irritating use on human skin; and selecting pad material that is medically approved for non-irritating application on exposed, medicated, or healing nail beds; thereby avoiding irritation of the nail area of the affected digit.

13. The method of claim 10, further comprising the step of:

simulating the appearance of a nearby normal nail by selecting pad material that has a thickness predetermined to be comparable to that of a typical nail for users in a target market.

14. The method of claim 10, further comprising the step of:

simulating the appearance of a nearby normal nail by selecting tape material that is transparent or translucent, and is non-glossy.

15. The method of claim 10, further comprising the steps of:

providing the strip of adhesive tape in one or more tape widths; and providing the pad separately from the strip of adhesive tape, in one or more pre-cut shapes and sizes.

16. The method of claim 10, further comprising the steps of:

providing the cosmetic nail covering in a kit comprising separate components of:

the adhesive tape with adhesive coating on one side;

the pad material; and user instructions for constructing and applying a cosmetic nail covering that has a size and shape that the user determines to be appropriate for cosmetically covering the nail area of an affected digit.

17. The method of claim 10, further comprising the step of:

trimming an outside pad edge and a corresponding outside tape edge to form a desired shape and dimensions for the outside edge of the nail covering.

* * * * *